US005675312A

United States Patent [19]

Burnett

[11] Patent Number: 5,675,312

[45] Date of Patent: Oct. 7, 1997

[54] PIEZOELECTRIC WARBLER

[75] Inventor: George Alan Burnett, Clayton, Ind.

[73] Assignee: Yosemite Investment, Inc., Indianapolis, Ind.

[21] Appl. No.: 561,555

[22] Filed: Nov. 21, 1995

Related U.S. Application Data

[63] Continuation of Ser. No. 253,039, Jun. 2, 1994, abandoned.

[51] Int. Cl.[6] ..... G08B 3/10

[52] U.S. Cl. ..... 340/384.72; 340/384; 340/384.7; 331/49; 331/68

[58] Field of Search ..... 340/384, 387.7; 331/49, 68

[56] References Cited

U.S. PATENT DOCUMENTS

| | | | |
|---|---|---|---|
| 4,179,690 | 12/1979 | Nicholls | 340/384.72 |
| 4,193,060 | 3/1980 | Slavin et al. | 340/384.72 |
| 4,558,305 | 12/1985 | Blacke et al. | 340/384.72 |
| 4,626,799 | 12/1986 | Matievic | 331/47 |

OTHER PUBLICATIONS

Mims, Forest M. III, "Radio Shack Engineer's Mini-Notebooks" 555 Circuits, p. 23 (1993).

National Semiconductor CMOS Logic Data Book, "MM74COO Data Sheets", pp. 6–9 thru 6–12 (1988).

National Semiconductor Linear Data Book 3, "LM556C Dual Timer Data Sheets", pp. 5–46 thru 5–49 (1988).

*Primary Examiner*—Jeffery Hofsass
*Assistant Examiner*—Daryl C. Pope
*Attorney, Agent, or Firm*—Niro, Scavone, Haller & Niro

[57] ABSTRACT

An electronic audio circuit operates a piezoelectric audio transducer to produce a two-tone warbling audio output. The electronic circuit includes an integrated circuit double timer and integrated circuit logic gates. One timer produces a toggling frequency that operates a toggling circuit composed of a logic gate to electrically connect and disconnect an electrical component from a frequency determining network to produce two frequency determining networks. The other timer produces two tones depending upon which frequency determining network is electrically connected to the other timer. The two tone are buffered and then drive a two-element piezoelectric transducer.

18 Claims, 5 Drawing Sheets

PIEZOELECTRIC WARBLER

This is a continuation of application Ser. No. 08/253,039 filed on Jun. 2, 1994 which is now abandoned.

BACKGROUND

This invention relates to oscillators used in an audio tone signaling devices, and more particularly to the use of one oscillator to vary the frequency of another oscillator used in an audio tone signaling device to produce a warbling sound from a piezoelectric transducer.

Audio tone signaling devices are widely used for applications to signal functions such as the end of an operating cycle, the end of a period is of time, or a reminder of something. More specific applications of a audio tone signaling device are on farm implements and heavy construction equipment to signal when such equipment is placed in reverse. Because humans have become accustomed to ignore steady, single frequency sounds, signal devices that warble or alternate between two frequencies have become common, particularly in alarms. Piezoelectric warbling audio devices are often selected for applications with limited space and for operation in a harsh environment. Some examples of specific applications for warbling piezoelectric audio signaling devices are in heavy construction equipment, farm implements, and behind medical device control panels.

Some previous warbling piezoelectric audio signaling devices have employed two piezoelectric transducers that each have a separate audio frequency circuit which are used to alternately operate the piezoelectric transducers to produce a warbling tone.

Some previous warbling piezoelectric signaling devices have employed more than one audio frequency circuit that are toggled to drive a piezoelectric transducer at different times. An example of a piezoelectric warbling device that uses a single piezoelectric transducer driven by more than one audio frequency circuit is disclosed in U.S. Pat. No. 4,626,799 issued to Matievic.

Some previous multi-tone generator circuits have employed a control circuit that enable and disables two or more audio oscillator circuits to produce two or more distinguishable audio sounds. An example of a multi-tone generator circuit is disclosed in U.S. Pat. No. 4,193,060 issued to Slavin et al.

What is needed is a warbling piezoelectric audio signally device that uses a single audio circuit that has frequency determining network that can be electrically modified to produce more than one audio frequency. What is also needed is a warbling audio signaling device that requires little housing residential space that is simple to produce and inexpensive.

SUMMARY

It is an object of the invention to provide a simple, inexpensive warbling piezoelectric audio circuit.

It is another object of the invention to provide a warbling piezoelectric circuit that occupies very little residential space in a piezoelectric audio tone signaling device housing.

It is yet another object of the invention to use a single audio frequency circuit that produces one audio frequency output for a period of time and another audio frequency out for another period of time determined by a toggling frequency.

It is a further object of the invention to electrically connect and disconnect frequency determining components to the single audio frequency determining network to produce two different audio frequencies.

I have invented a warbling piezoelectric audio circuit that comprises a tone generator, a toggling timer, a piezoelectric transducer, and a toggling circuit. The tone generator has a first frequency determining network to produce a first audio frequency and a second frequency determining network to produce a second audio frequency. The second frequency determining network comprises at least one electrical component that is electrically connected to the first frequency determining network by the toggling circuit to produce the second frequency determining network. The toggling timer produces a toggling frequency that controls the toggling circuit to switch between the first frequency determining network and the second frequency determining network.

BRIEF DESCRIPTION OF THE DRAWINGS

These and other features, aspects, and advantages of the present invention will become understood with regard to the following description, appended claims, and accompanying drawings where:

DETAILED DESCRIPTION

Figure 1:
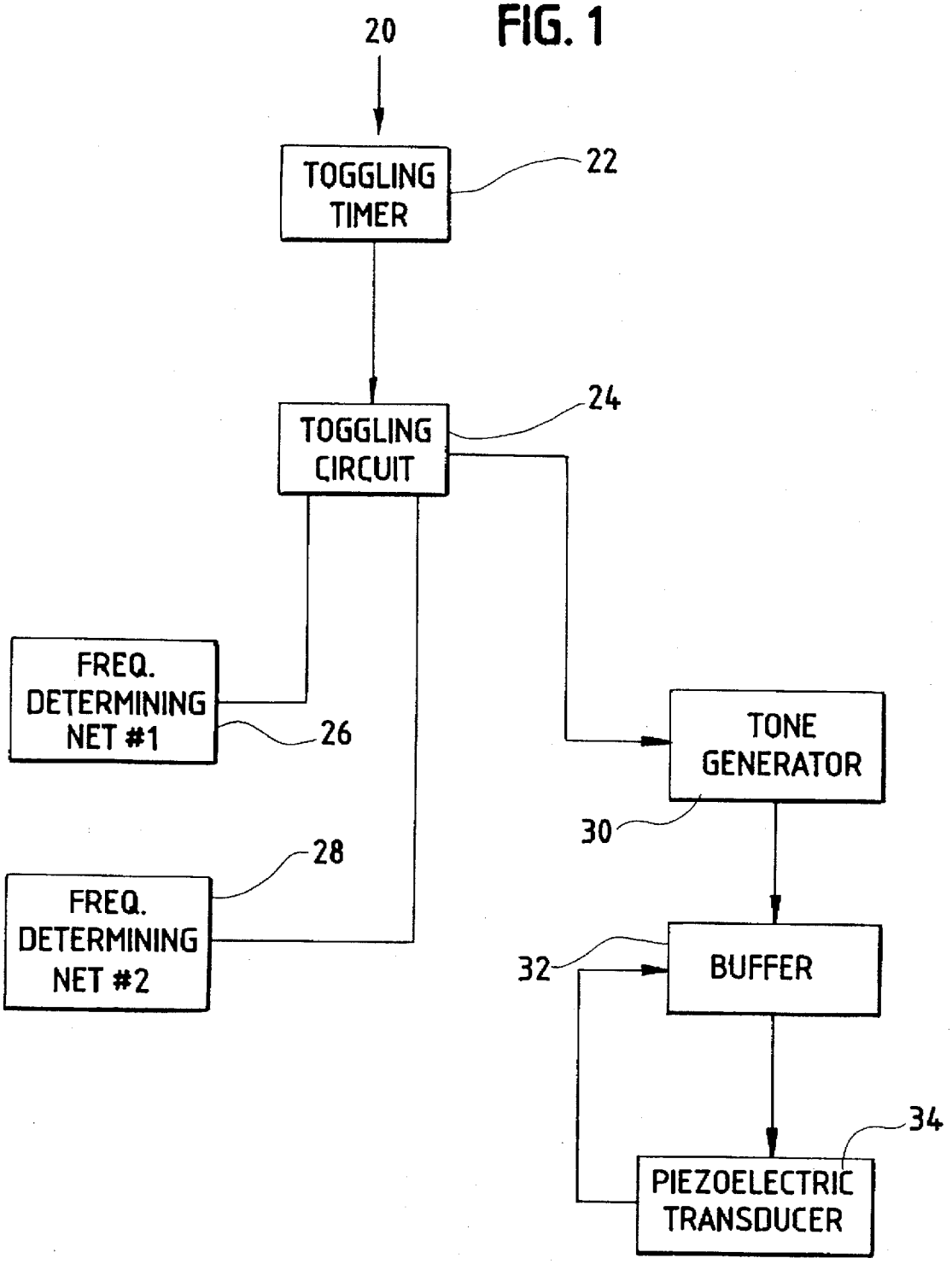
FIG. 1 shows a block diagram of a warbling piezoelectric audio circuit.

Referring to FIG. 1, the warbling piezoelectric audio circuit 20 generally comprises a toggling timer 22, a toggling circuit 24, a first frequency determining network 26, a second frequency determining network 28, a tone generator 30, a buffer 32, and a piezoelectric transducer 34.

Figure 2:
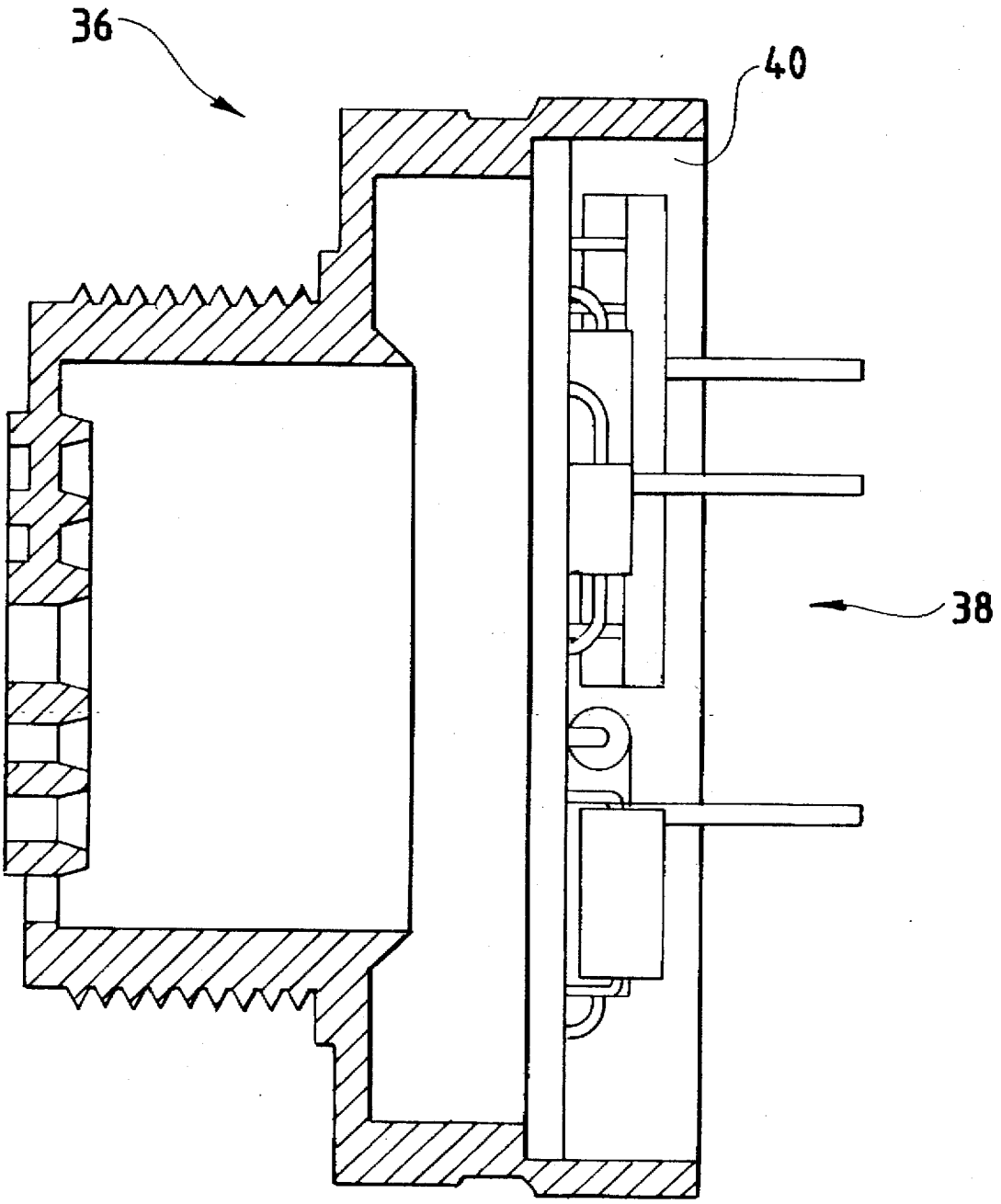
FIG. 2 shows a sectioned view of a housing for the warbling piezoelectric audio circuit.

Referring to FIG. 2, the warbling piezoelectric audio circuit housing 36 is circular with an overall diameter of about 1.7 inches (4.32 cm) and an overall depth of about 1.08 inches (2.74 cm). A printed circuit board 38 fits in a circular housing cavity 40 having dimensions of about 1.6 inches (4.06 cm) in diameter and 0.3 inches (0.76 cm) deep.

Figure 3:
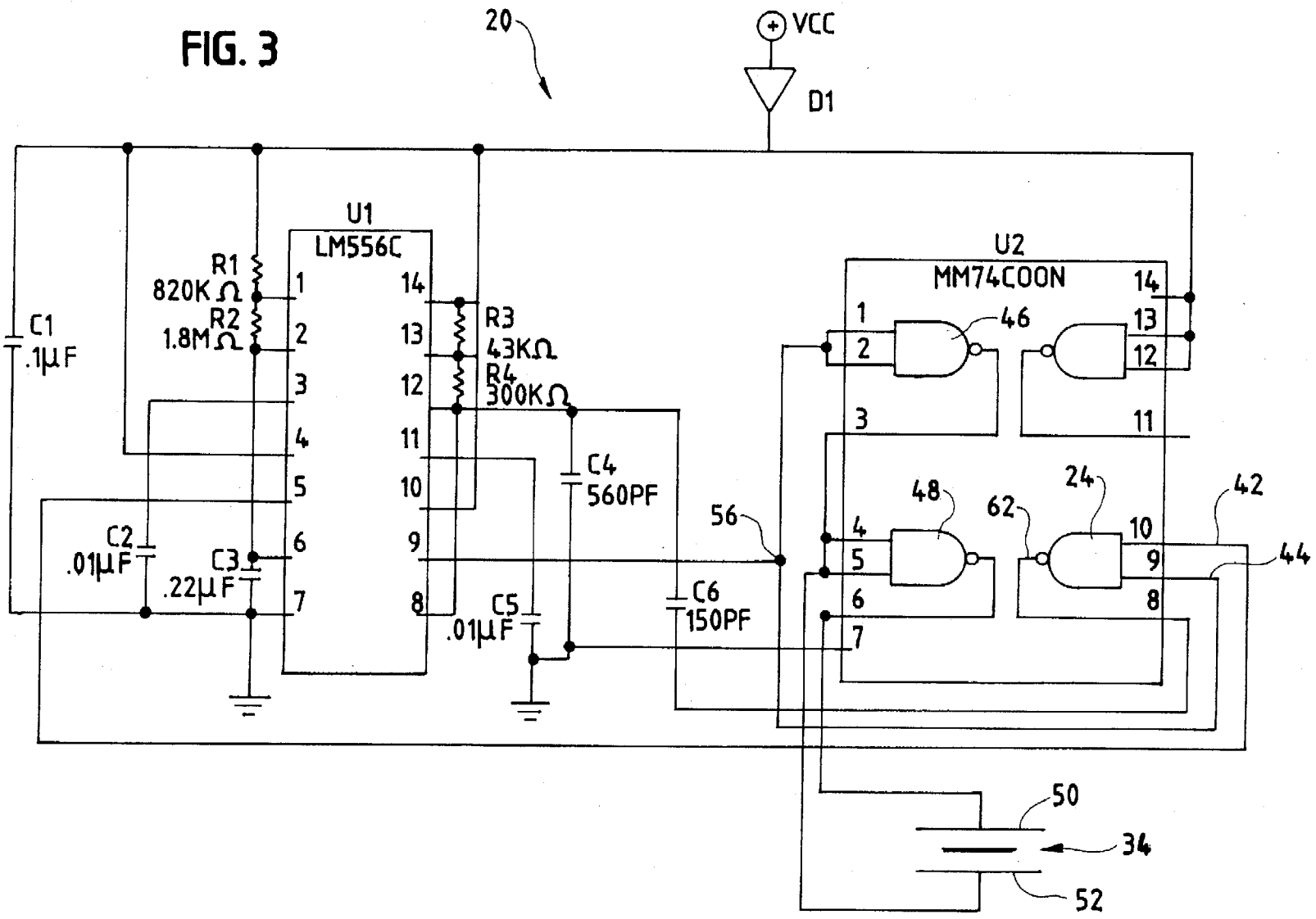
FIG. 3 shows a schematic of the warbling piezoelectric audio circuit.

Referring to FIG. 3, the warbling piezoelectric audio circuit 20 is designed to be powered by a 6–16 VDC regulated power supply. Diode D1 is provides protection to the warbling piezoelectric audio circuit from reversing the polarity of the power supply. Capacitor C1 filters any transients from the power supply to ground. The warbling piezoelectric audio circuit 20 is typically activated by application of power to the warbling piezoelectric audio circuit 20.

Referring to FIGS. 1 and 3, both the toggling timer 22 and tone generator 30 are provided by a single integrated circuit (IC) dual timer U1 preferably a National Semiconductor® LM556 dual timer available from National Semiconductor Corporation at 2900 Semiconductor Drive, P.O. Box 58090, Santa Clara, Calif. 95052-8090. The toggling timer 22 has a network of resistors R1 and R2, along with capacitor C3 to establish the toggling timer's 22 frequency at about 1.0 Hz. The values of R1, R2, and C3 can be varied to set the toggling timer frequency in the range from 0.5 Hz to 3.0 Hz. Toggling timer capacitor C2 sets a control voltage to ensure proper operation of IC U1.

The tone generator 30 has a first frequency determining network of resistors R3 and R4 along with capacitor C4 to set the tone generator's 30 first frequency at about 2,858 Hz. The values of R3, R4, and C4 can be varied to set the first frequency in a range from 2,500 Hz to 3,500 Hz. The tone generator has a second frequency determining network of resistors R3 and R4 along with capacitors C4 and C6 to set the tone is generator's 30 second frequency at about 1,984 Hz. The values of R3, R4, C4 and C6 can be varied to set the second frequency in a range from 1,000 Hz to 2,500 Hz. Tone generator 30 capacitor C5 sets a control voltage to ensure proper operation of IC U1.

The toggling circuit 24 is a NAND gate which is preferably provided by a National Semiconductor NM74C00N quad NAND gate integrated circuit. The first toggling circuit input 42 comes from the toggling timer 22 output, U1 pin 5. The second toggling circuit input 44 comes from the output of the tone generator 30, U1 pin 9.

When the first toggling circuit input 42 and the second toggling circuit input 44 are low, capacitor C6 is electrically disconnected from U1, pin 12 to produce the first frequency determining network of R3, R4, C4, and C5 to set the first frequency at about 2858 Hz. When both the first toggling circuit input 42 and the second toggling circuit input 44 are high, capacitor C6 is electrically connected in parallel with capacitor C4 of the first frequency determining network to produce the second frequency determining network of resistors R3 and R4 along with capacitors C4 and C5 to set the tone generator's second frequency at about 1,984 Hz.

The buffer 32 comprises NAND gates 46 and 48 which are electrically connected to drive elements 52 and 50, respectively of the piezoelectric transducer 34 and operate in a push-pull or complimentary fashion in order to increase the voltage swing across drive elements 50 and 52. The piezoelectric transducer has two electrical drive elements 50 and 52 such as can be is found in a Sonalert® part number SC628D available from North American Capacitor Company 7545 Rockville Road, P.O. Box 1284, Indianapolis, Ind. 46206-1284; telephone number (317) 273-0090. The piezoelectric transducer is an external drive piezoelectric acoustic generator having an audio output of at least 80 dB. The piezoelectric transducer is available as a KBS series piezoelectric transducer from Kyocera, P.O. Box 867, 17th Avenue South, Myrtle Beach, S.C. 29577.

Operation

Referring to FIG. 3, when power is applied to the warbling piezoelectric audio circuit the dual timer IC U1 is reset by application of power to U1 pin 4 and U1 pin 10. The toggling timer frequency, determining network of resistors R1, R2 and capacitor C3 establish the toggling frequency of about 1.0 Hz.

Figure 4A:
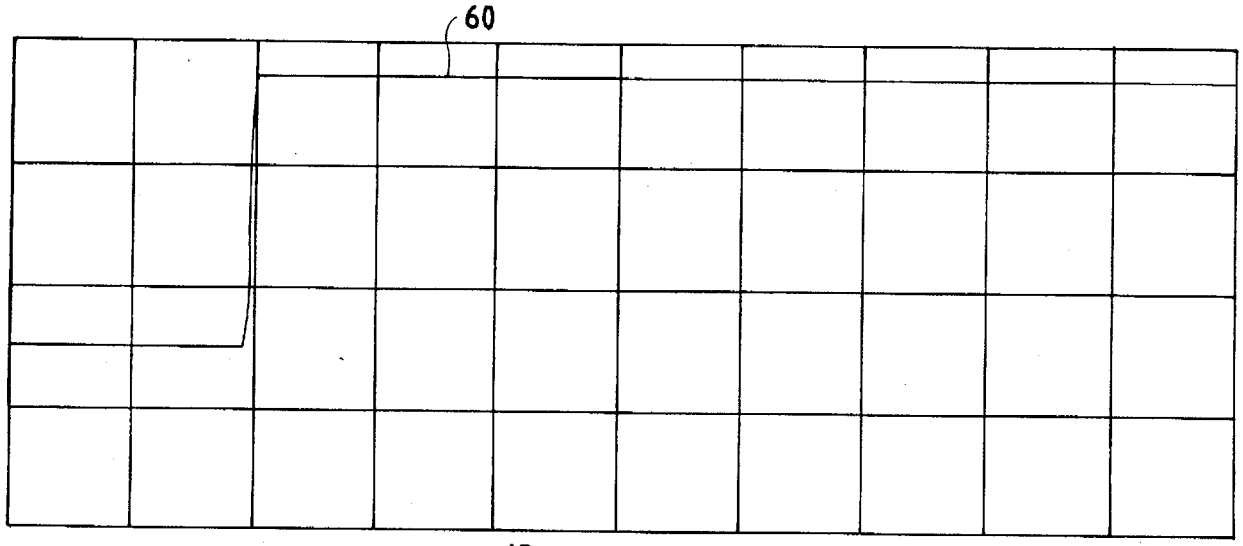
FIG. 4*a* shows a signal timing diagram of a toggling timer signal.
Figure 4B:
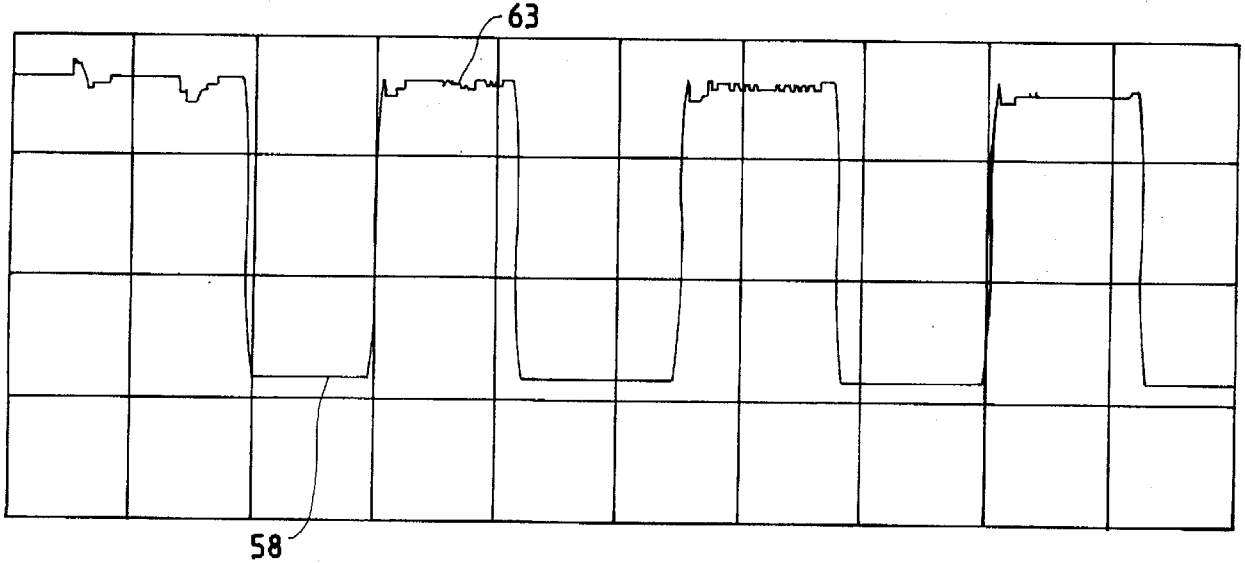
FIG. 4*b* shows a signal timing diagram of a toggling circuit output.

Referring to FIGS. 1, 3, and 4*a–b* where FIG. 4*a* is a signal timing diagram of the signal seen in FIG. 3 at 42 and FIG. 4*b* is a signal timing diagram of the signal seen in FIG. 3 at 62. In FIG. 4*b* when the signal is low 58, capacitor C6 is electrically connected to the first frequency determining network 26 of R1, R2, and C2 to form the second frequency determining network 28 of R1, R2, C2, and C6. When the signal is high 63, capacitor C6 is electrically disconnected from the second frequency determining network 28 to once again form the first frequency determining network 26.

Figure 5A:
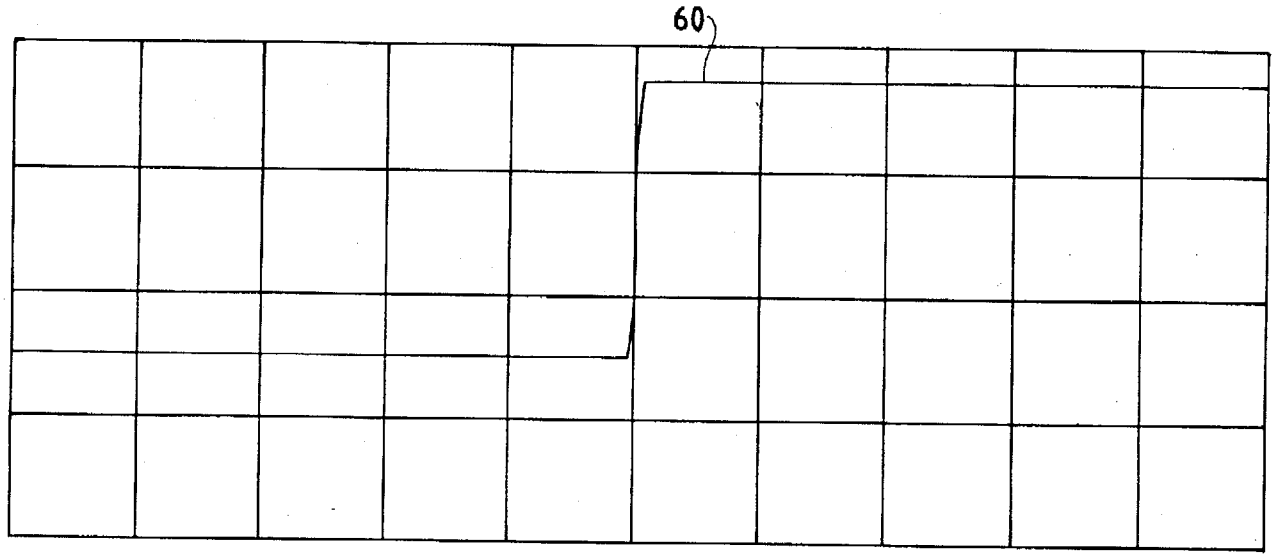
FIG. 5*a* shows a signal timing diagram of a toggling timer signal.
Figure 5B:
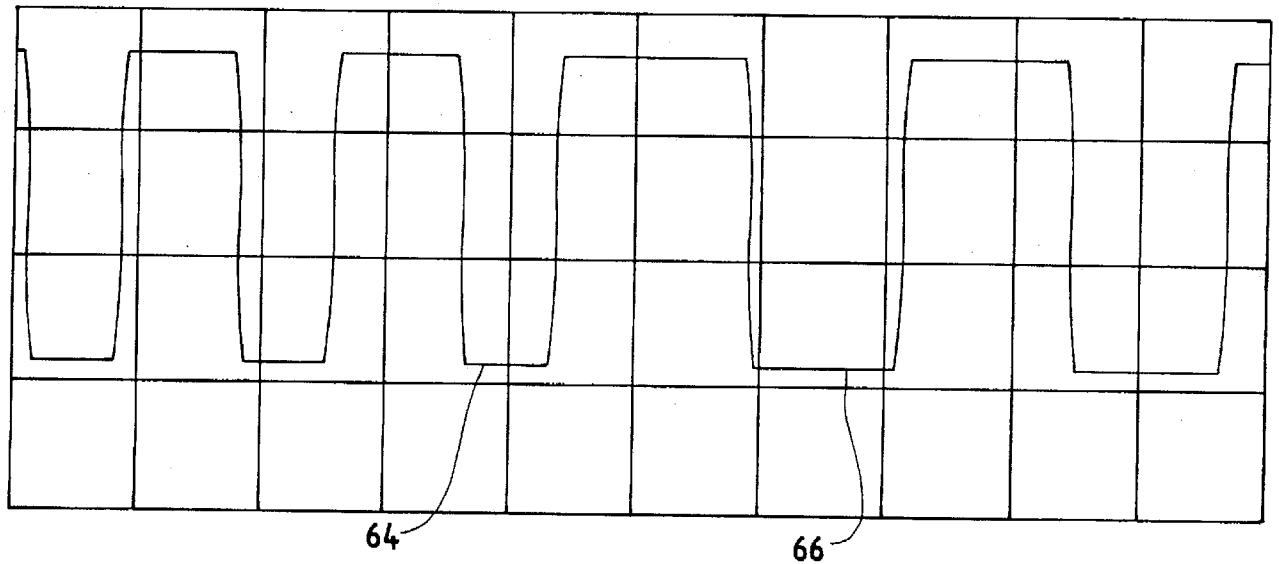
FIG. 5*b* shows a signal timing diagram of a first audio frequency and a second audio frequency.

Referring to FIGS. 3 and 5*a–b* where FIG. 5*a* is a signal timing diagram of the signal seen in FIG. 3 at 42, and FIG. 5*b* is a signal timing diagram of the signal seen in FIG. 3 at 56. The piezoelectric transducer 34 receives the first audio frequency 64 for a predetermined period of time determined by the toggling timer frequency 60 and receives the second audio frequency 66 for another predetermined period of time determined by the toggling timer frequency 60 to produce a warbling audio signal.

What is claimed is:

1. A warbling piezoelectric audio circuit, comprising:

(a) a single audio oscillator having a first frequency determining network to produce a first audio frequency and a second frequency determining network to produce a second audio frequency;

(b) a toggling timer producing a toggling frequency that is used to control the rate at which the single audio oscillator produces the first audio frequency and the second audio frequency;

(c) a piezoelectric transducer receiving from the single audio oscillator the first audio frequency for a predetermined period of time determined by the toggling frequency and receiving the second audio frequency for another predetermined period of time determined by the toggling frequency to produce a warbling audio signal; and, (d) a toggling circuit logic gate receiving the toggling frequency from the toggling timer to electrically connect the second frequency determining network to the single audio oscillator to provide the second audio frequency to the piezoelectric transducer to produce the second audio frequency for a predetermined period of time determined by the toggling frequency and electrically disconnect the second audio frequency network from the single audio oscillator to provide the first audio frequency to the piezoelectric transducer to produce the first audio frequency for another predetermined period of time determined by the toggling frequency.

2. The warbling piezoelectric audio circuit recited in claim 1 wherein the second frequency determining network comprises at least one reactive electrical component that is electrically connected to the first frequency determining network to produce the second frequency determining network.

3. The warbling piezoelectric audio circuit recited in claim 2 wherein the electrical component is a capacitor.

4. The warbling piezoelectric audio circuit recited in claim 1 wherein the piezoelectric transducer has two electrical drive elements.

5. The warbling piezoelectric audio circuit recited in claim 1 wherein the warbling piezoelectric audio circuit fits in a circular housing that has an overall diameter of less than 2.0 inches (5.08 cm) and an overall depth of less than 1.5 inches (3.81 cm).

6. The warbling piezoelectric audio circuit recited in claim 1 wherein the single audio oscillator and the toggling timer are contained in a single integrated circuit.

7. The warbling piezoelectric audio circuit recited in claim 6 wherein the single integrated circuit is a dual timing circuit.

8. The warbling piezoelectric audio circuit recited in claim 1 wherein the first audio frequency ranges from 2,500 Hz to 3,500 Hz.

9. The warbling piezoelectric audio circuit recited in claim 1 wherein the second audio frequency ranges from 1,000 Hz to 2,500 Hz.

10. The warbling piezoelectric audio circuit recited in claim 1 wherein the toggling frequency ranges from 0.5 Hz to 3.0 Hz.

11. The warbling piezoelectric audio circuit recited in claim 1 wherein the piezoelectric transducer has an audio output of at least 80 dB.

12. The warbling piezoelectric audio circuit as recited in claim 1 wherein the first audio frequency, the second audio frequency, and the toggling frequency are each independently adjustable.

13. The warbling piezoelectric audio circuit as recited in claim 2 wherein the reactive component is electrically connected to the first frequency determining network by a toggling circuit logic gate that electrically connects the reactive component to ground.

14. A method of producing a warbling piezoelectric audio signal, comprising the steps of:

(a) providing a single audio oscillator having a first frequency determining network to produce a first audio frequency and a second frequency determining network to produce a second audio frequency;

(b) providing a toggling timer to produce a toggling frequency;

(c) providing a piezoelectric transducer receiving the first audio frequency for a predetermined period of time determined by the toggling frequency and receiving the second audio frequency for another predetermined period of time determined by the toggling frequency to produce a warbling audio signal;

(d) connecting electrically the second frequency determining network to the single audio oscillator to produce the second audio frequency for a predetermined period of time determined by the toggling frequency; and, (e) disconnecting electrically the second frequency determining network from the single audio oscillator to produce the first audio frequency for another predetermined period of time determined by the toggling frequency.

15. The method recited in claim 14 wherein the second frequency determining network comprises at least one reactive electrical component that is electrically connected to the first frequency determining network to produce the second frequency determining network.

16. The method as recited in claim 15 wherein the electrical component is a capacitor.

17. The method as recited in claim 14 wherein the piezoelectric transducer has two electrical drive elements.

18. The method as recited in claim 14 wherein the warbling piezoelectric audio circuit fits in a circular housing that has an overall diameter of less than 2.0 inches (5.08 cm) and an overall depth of less than 1.5 inches (3.81 cm).

* * * * *